US005477978A

United States Patent [19]

Lo

[11] Patent Number: 5,477,978

[45] Date of Patent: Dec. 26, 1995

[54] BEVERAGE CUP WITH STRAW ATTACHED THERETO

[76] Inventor: Hsin-Hsin Lo, 9, Alley 3, Lane 35, Weitao Rd., N. Dis. Taichung, Taiwan

[21] Appl. No.: 237,164

[22] Filed: May 3, 1994

[51] Int. Cl.[6] ..... B65D 47/06

[52] U.S. Cl. ..... 220/710; 206/217; 229/400; 215/229; 215/388

[58] Field of Search ..... 220/710, 705; 206/217; 229/1.5 B; 215/1 A, 229

[56] References Cited

U.S. PATENT DOCUMENTS 3,406,868 10/1968 Rogers ..... 220/710
3,921,889 11/1975 Gibbons ..... 220/710
4,228,913 10/1980 Mack et al. ..... 220/710
4,350,927 11/1982 Cooper et al. ..... 220/710

*Primary Examiner*—Joseph M. Moy
*Attorney, Agent, or Firm*—Larson and Taylor

[57] ABSTRACT

A beverage cup with a straw attached thereto is provided on the inner wall surface thereof with an elongate straw housing of hollow construction and so dimensioned as to receive therein movably a straw. The straw housing has a bottom end distant from the bottom of the beverage cup to permit the bottom end of the straw to be submerged in the beverage. The straw housing has one longitudinal side that is sealed and is cemented to the inner wall surface of the beverage cup, while the straw housing has another longitudinal side that is so open as to permit the straw to be removed therefrom by force and to prevent the straw from escaping from the straw housing.

1 Claim, 2 Drawing Sheets

BEVERAGE CUP WITH STRAW ATTACHED THERETO

BACKGROUND OF THE INVENTION

The present invention relates generally to a beverage cup, and more particularly to a beverage cup with a straw thereto.

In recent years, more people use the disposable beverage cup of waxed paper in place of the conventional beverage glass. When people drink beverage, they often like to drink it through a straw, which is a hollow tube of waxed paper, plastic, ect. and is submerged at one end thereof in the cup for sucking the beverage contained in the cup. However, people are often inconvenienced by the fact that straws are not always available at the time when they drink the beverage.

SUMMARY OF THE INVENTION

It is therefore the primary objective of the present invention to provide a beverage cup of paper or other material with a straw which is attached to the beverage cup.

The foregoing objective of the present invention is accomplished by a beverage cup with a straw attached thereto. The beverage cup is provided on the inner wall surface thereof with an elongate straw housing of hollow construction and so dimensioned as to receive therein movably a straw. The straw housing has a bottom end distant from the bottom of the cup to permit the bottom end of the straw to be submerged in the beverage. The straw housing has one side that is sealed and is comented to the inner wall surface of the cup, while the straw housing has another side that is so open as to permit the straw to be removed therefrom by force.

The foregoing objective and features of the present invention will be better understood by studying the following detailed description of the present invention in conjunction with the drawings provided herewith.

DETAILED DESCRIPTION OF THE INVENTION

Figure 3:
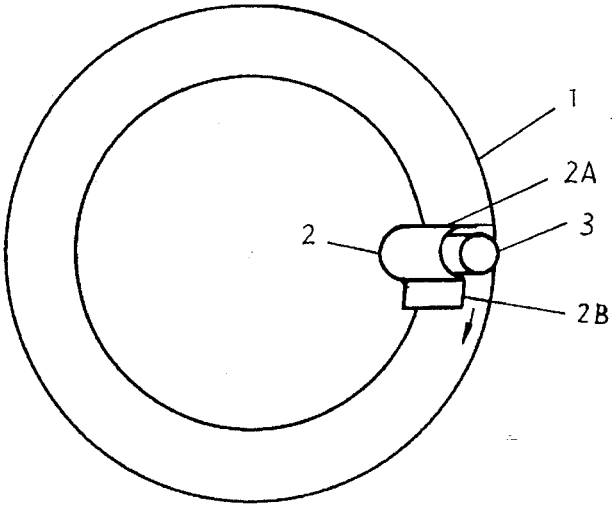
FIG. 3 shows a perspective schematic view of the present invention.
Figure 1:
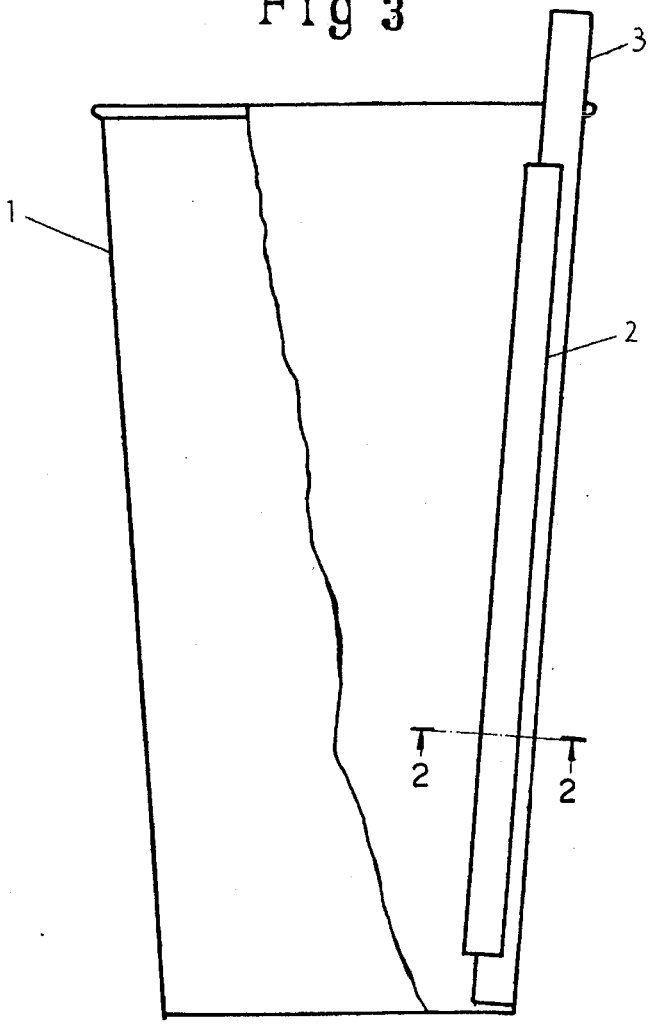
FIG. 1 shows a perspective view of the present invention.
Figure 2:
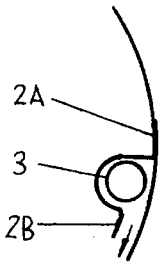
FIG. 2 shows a sectional view of a portion taken along the line A—A as shown in FIG. 1.
Figure 4:
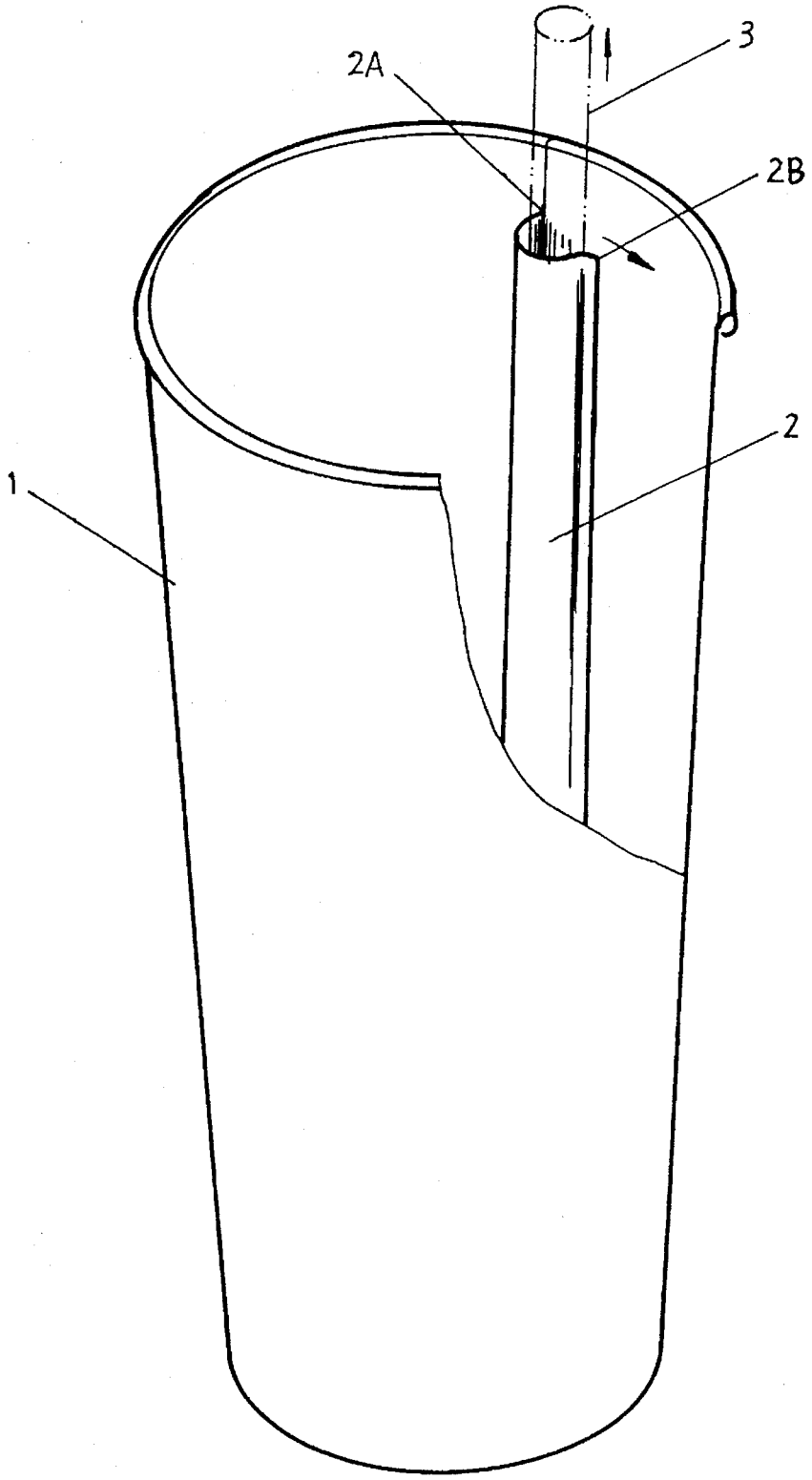
FIG. 4 shows a perspective schematic view of the present invention at work.

Referring to FIGS. 1, 2 and 3, a beverage cup 1 of paper or other material and embodied in the present invention is shown to comprise a hollow straw housing 2 of elongate tubular construction, which is attached to a folded line area on the inner wall surface or other areas on the inner wall surface of the cup 1. The straw housing 2 is so dimensioned as to receive therein movably a straw 3 whose dimension is matched with the size of the beverage cup 1. The straw housing 2 has a bottom end distant from the bottom of the beverage cup 1 to permit the bottom end of the straw 3 to be submerged in the beverage. The straw housing 2 has a longitudinal side 2A that is sealed and is cemented to a folded line area on the inner wall surface or other areas on the inner wall surface of the beverage cup 1. In addition, the straw housing 2 has another longitudinal side 2B that is so open as to permit the straw 3 to be removed therefrom by force, and to prevent the straw 3 from escaping from the straw housing 2.

As shown in FIG. 3, the beverage cup 1 is provided with a straw 3 which is received in the straw housing 2. If a user of the beverage cup 1 would like to stir up the beverage contained in the beverage cup 1, he or she may remove the straw 3 easily from the top opening of the straw housing 2 or from the side 2B of the straw housing 2. With the straw 3 being so removed, the user of the beverage cup 1 can stir up the beverage contained in the beverage cup 1.

The beverage cup 1 of the present invention is so ingeniously designed that it comprises the straw housing 2 in which the straw 3 is disposed. Such beverage cup 1 of the present invention can be made easily and would not cause a space problem in the packing of the cup. In addition, the straw 3 is attached to the inner wall of the beverage cup 1 and therefore enables the user of the beverage cup 1 to suck up easily the last drop of the beverage contained in the cup 1. With the beverage cup 1 of the present invention, the consumers at large ace no longer inconvenienced by the fact that they can not find a straw at the time when they need it.

The embodiment of the present invention described above is to be regarded in all respects as merely illustrative and not restrictive, Accordingly, the present invention may be embodied in other specific forms without deviating from the spirit thereof. The present invention is therefore to be limited only by the scope of the following appended claims.

What is claimed is:

1. A beverage cup including a straw housing having a hollow tubular construction which is open at top and bottom ends for receiving a straw therein, said straw housing comprising a first longitudinal side cemented to an area on an inner wall surface of said beverage cup such that the bottom end of said straw housing is at a distance from a bottom of said beverage cup and a second longitudinal side having an opening along a length thereof, said opening being dimensioned to maintain a straw in said straw housing while allowing the straw to be removed from said straw housing through said opening by applying a force to the straw.

* * * * *